US007343771B2

(12) United States Patent
Marx

(10) Patent No.: US 7,343,771 B2
(45) **Date of Patent: *Mar. 18, 2008**

(54) DECK LEVERAGE ANCHOR WITH SWIVEL MECHANISM

(76) Inventor: Michael Marx, 5490 Ormond Rd., White Lake, MI (US) 48383

( * ) Notice: Subject to any disclaimer, the term of this patent is extended or adjusted under 35 U.S.C. 154(b) by 376 days.

This patent is subject to a terminal disclaimer.

(21) Appl. No.: 10/993,307

(22) Filed: Nov. 19, 2004

(65) Prior Publication Data

US 2005/0108958 A1 May 26, 2005

Related U.S. Application Data

(63) Continuation-in-part of application No. 10/707,134, filed on Nov. 21, 2003.

(60) Provisional application No. 60/522,014, filed on Aug. 2, 2004.

(51) Int. Cl.
*B21J 13/08* (2006.01)

(52) U.S. Cl. ..... 72/457; 72/705

(58) Field of Classification Search ..... 72/311, 72/322, 446, 447, 457, 705; 248/500, 503, 248/680; 52/166, 702
See application file for complete search history.

(56) References Cited

U.S. PATENT DOCUMENTS

| | | | | | |
|---|---|---|---|---|---|
| 4,138,877 | A | * | 2/1979 | Specktor | 72/461 |
| 4,519,236 | A | | 5/1985 | Celette | |
| 4,643,014 | A | * | 2/1987 | Eppinger | 72/305 |
| 4,699,410 | A | | 10/1987 | Seidel | |
| 4,748,842 | A | | 6/1988 | Dingman | |
| 4,915,342 | A | * | 4/1990 | Nilsson | 248/500 |
| 4,930,333 | A | * | 6/1990 | Marbury | 72/447 |
| 4,941,343 | A | * | 7/1990 | Stancato | 72/447 |
| 4,959,991 | A | | 10/1990 | Andersson | |
| 5,692,402 | A | | 12/1997 | Clements | |
| 5,823,588 | A | * | 10/1998 | Morghen | 294/1.1 |
| 2003/0196474 | A1 | | 10/2003 | McClellan et al. | |

* cited by examiner

*Primary Examiner*—Ed Tolan
(74) *Attorney, Agent, or Firm*—Harness, Dickey & Pierce, P.L.C.

(57) ABSTRACT

A deck leverage anchor for securing an external device has an anchor body that is positioned at least partially within an opening of the deck so that a notch receives the edge of the surface. The anchor body comprises a swivel coupler that extends outward from the opening. The swivel coupler couples to an external device. A swivel plate is disposed opposite the swivel coupler to engage and distribute a load on the surface of the deck opposite the coupler.

48 Claims, 5 Drawing Sheets

DECK LEVERAGE ANCHOR WITH SWIVEL MECHANISM

RELATED APPLICATION

The present invention is a continuation-in-part of U.S. patent application Ser. No. 10/707,134, filed Nov. 21, 2003, entitled "Deck Leverage Anchor", and the provisional application 60/522,014 filed Aug. 2, 2004, the disclosures of which are incorporated by reference herein.

TECHNICAL FIELD

The present invention relates generally to frame racks, and more specifically, to an apparatus to couple a hydraulic ram to a frame deck.

BACKGROUND

Frame racks are typically used to straighten the frame of an automotive vehicle after a collision. A frame rack has a deck onto which the vehicle is placed. A number of towers are positioned around the frame rack. The towers have a chain connected thereto that is coupled to a ram. The chains are connected to the frame of the vehicle and the tower is used to pull the chain toward the tower. Typically, the chains are connected to the vehicle so that the vehicle frame is pulled out in the same direction of impact. When the pulling of the frame begins, it is often necessary to adjust the direction of pulling so the pulling force remains in the direction of impact. Oftentimes, this requires the tension to be released from the vehicle, the tower position to be adjusted, and tension placed on the vehicle frame in a slightly different direction. This, however, is a time consuming process and thus increases the expense of the collision repair.

To place tension on the vehicle in a slightly different direction, a separate hydraulic ram is sometimes coupled to a frame deck. The hydraulic ram may provide push/pull capabilities. Because a tower may not be available, a portable hydraulic ram may be used. The portable hydraulic ram is typically coupled to the frame deck using hooks. One problem with using a hook is that the frame deck is typically formed of a sheet of steel material, commonly 0.5" thick. Although the thickness is substantial, the frame deck may easily be bent when localized pulling on the order of thousands of pounds takes place during a straightening operation. If the frame rack is damaged, expensive repairs may be required to be performed. This may result in lost time and thus revenue for the frame rack operator.

It would therefore be desirable to provide a system for allowing flexibility in the frame straightening process and reduce potential damage to frame racks. Also, it is desirable to allow pulling at various angles with respect to the deck.

SUMMARY OF THE INVENTION

It is therefore one object of the invention to provide a system suitable for use with a hydraulic actuator that can be easily maneuvered and positioned on a deck such as a deck of a frame rack.

In one aspect of the invention, an anchor device for coupling an external device to a surface of a deck so that the anchor device is received within an opening in the surface. The opening has an edge therein. The anchor device includes an anchor body that is positioned at least partially within the opening so that a notch receives the edge of the surface. The anchor device further comprises a swiveling coupler that extends outward from the opening. The swiveling coupler couples to the external device. A swivel plate is coupled to the swiveling coupler on the other side of the surface from the swiveling coupler.

In a further aspect of the invention, a method for operating a frame rack comprises inserting a portion of a leverage anchor into an opening in the surface of a frame rack, engaging the frame rack surface into a notch of the leverage anchor, rotating a swiveling coupler portion and a swivel plate of the anchor device so that the swivel plate engages the frame rack beneath the surface, and coupling the hydraulic ram to the anchor device.

One advantage of the invention is that frame rack damage may be substantially reduced or eliminated with the use of the deck leverage anchor according to the present invention. The deck leverage anchor distributes the pulling force across the opening of the deck surface such that localized deformation does not take place.

Another advantage of the invention is that the relatively compact size reduces the amount of deck space required for coupling.

Yet another advantage of the invention is that because of its ease and use, widespread adaptation is likely.

Other advantages and features of the present invention will become apparent when viewed in light of the detailed description of the preferred embodiment when taken in conjunction with the attached drawings and appended claims.

DESCRIPTION OF THE PREFERRED EMBODIMENT

Figure 1:
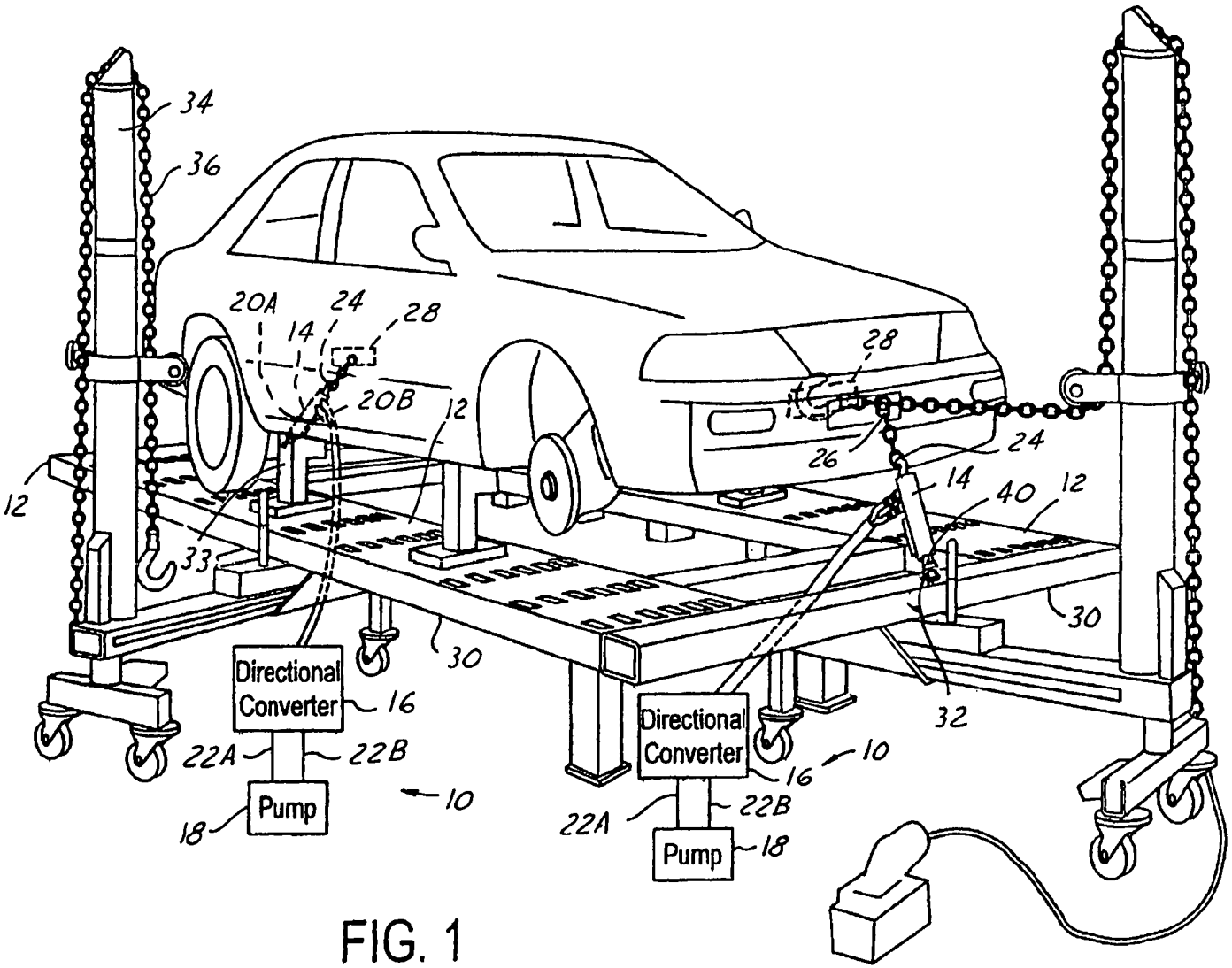
FIG. 1 is a perspective view of an automotive frame rack having a hydraulic system according to the present invention.

In the following figures, the same reference numerals will be used to identify the same components. The following description is set forth with respect to a frame rack for an automotive vehicle. However, the present application has several uses for mounting a device to a deck. It should also be noted that any quantities and dimensions are provided for illustrative purposes only and should not be limiting unless set forth in the claims of the present invention. Further, the embodiments set forth herein illustrate various alternative features. The various features, however, may be interchanged in the different embodiments. Further, although a two surface deck is used in the following examples, in its simplest form the deck may be a single planar surface.

Referring now to FIG. 1, two hydraulic frame straightening systems 10 according to the present invention are illustrated. Hydraulic systems 10 are illustrated used on a frame rack 12. As mentioned above, however, the frame rack 12 is merely illustrative of one of the many applications of the present invention. Hydraulic system 10 includes a hydraulic actuator 14, a directional converter 16, and a pump 18. A suitable directional converter is described in U.S. patent application Ser. No. 10/164,082 filed on Jun. 5, 2002, the disclosure of which is incorporated by reference herein. As illustrated, two hoses 20A and 20B, fluidically couple directional converter 16 and hydraulic actuator 14. Also, two hoses 22A and 22B fluidically couple directional converter 16 and pump 18. Hydraulic actuator 14 may have a mechanical coupling device such as a pair of claw hooks 24. It should be noted that in various applications claw hooks 24 may be substituted with other mechanical fastening devices such as bolt down components, loops, a deck leverage anchor 40 or stays. Claw hook 24 is illustrated mechanically coupled to a chain 26, which in turn is coupled to a portion of a frame 28 of an automotive vehicle.

Frame rack 12 may also include various towers 34 that include a ram 36 and a chain 38. Of course, different numbers of towers 34 may be used on a frame rack. A support 33 may be used to support the vehicle.

Frame rack 12 has a deck 30 for positioning a vehicle thereon. Deck 30 may have openings 32 or tie down holes positioned therethrough. The deck leverage anchor 40 according to the present invention may be secured at least partially within one of the openings 32.

Figure 2:
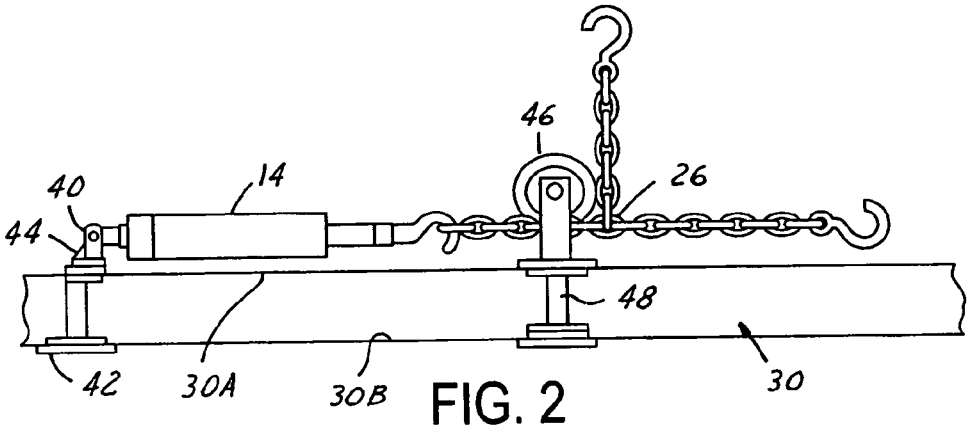
FIG. 2 is a side view of a leverage anchor coupled to a hydraulic actuator according to the present invention.

Referring now to FIG. 2, hydraulic actuator 14 or other external device is illustrated coupled to deck 30. Deck 30 may have a first surface 30A spaced apart from a second surface 30B. Deck leverage anchor 40 is coupled to the first surface 30A while a fastener plate 42 is coupled to second surface 30B. As will be further described below, deck leverage anchor 40 having an anchor body and fastener plate 42 are preferably coupled at least partially through their respective surfaces.

A pulley 46 may also be coupled to frame rack 30. Pulley 46 may be coupled to frame deck 30 using a pulley coupler 48. The pulley coupler 48 may be shaped similar to that of fastener plate 42. Pulley 46 is used to guide or route chain 46 to a desired position.

Figure 3:
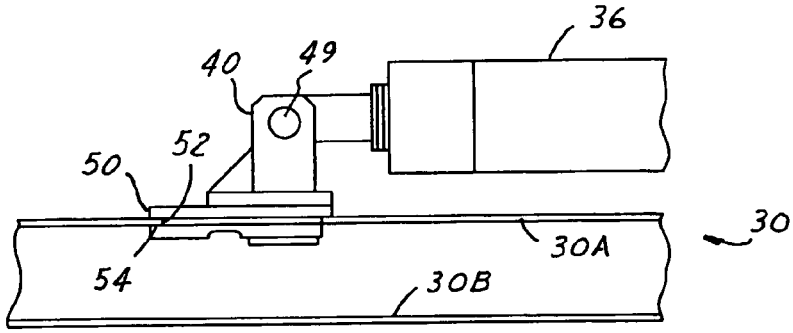
FIG. 3 is a side view of a leverage anchor coupled to a deck according to the present invention.

Referring now to FIG. 3, deck 30 is illustrated in further detail relative to deck leverage anchor 40. As can be seen, leverage anchor 40 is coupled to ram 36 using a pin or fastener 49. As can-be seen, the size of the deck leverage anchor 40 is such that a portion of the deck leverage anchor remains above the surface 30A on top of or on the outside surface of deck 30 while a portion of the deck leverage anchor extends below surface 30A. A notch 50 engages the opening 52 of the surface 30A so that an edge 54 of the surface 30A is positioned within notch 50. As will be further described below, the size of the deck leverage anchor 40 is such that it is larger than the opening 52. A portion of the deck leverage anchor 40 may be longer, wider or longer and wider than the opening 52.

Figure 4:
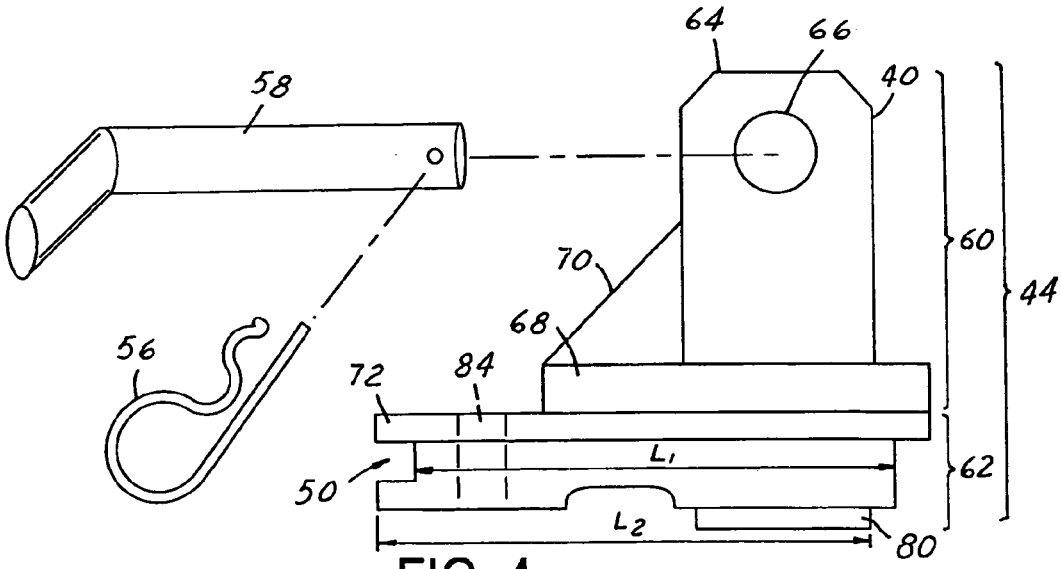
FIG. 4 is a side view of a deck leverage anchor according to a first embodiment of the invention.
Figure 5:
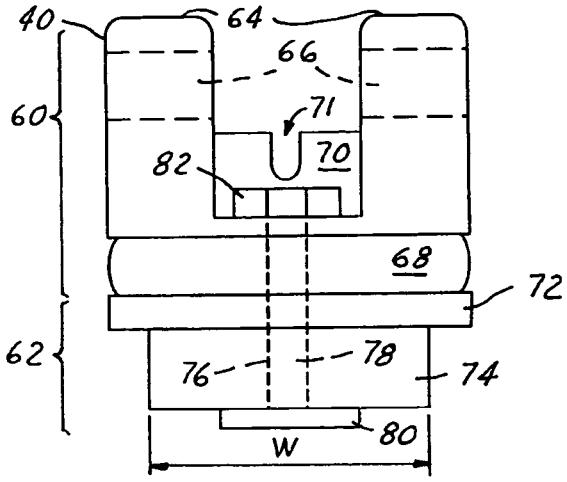
FIG. 5 is a right side view of the deck leverage anchor according to FIG. 4.
Figure 6:
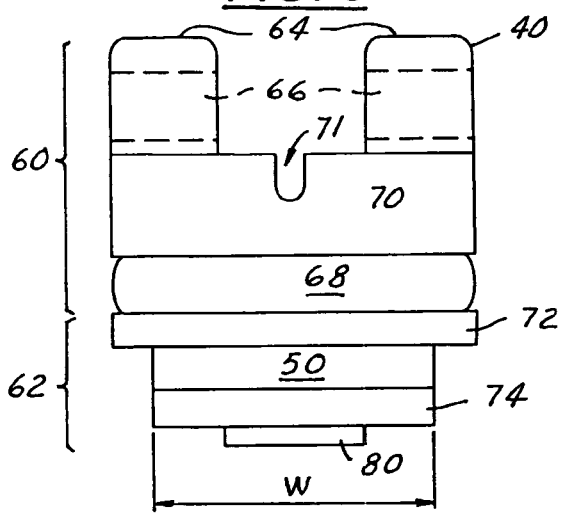
FIG. 6 is a left side view of the deck leverage anchor of FIG. 4.

Referring now to FIGS. 4, 5, and 6, deck leverage anchor 40 may be coupled to external device 58 through the use of a cotter pin 56 or other type of pin or fastener. A bolt or other device may also be used in place of cotter pin 56. Deck leverage anchor 40 may be formed of a unitary body structure 44 such as by CNC machines out of a single piece of steel. Thus, the whole deck leverage anchor may be formed of a unitary structure. The body 44 of the deck leverage anchor 40 may also be formed of two separate body portions; a first body portion 60 and a second body portion 62. First body portion 60 includes at least one coupler 64. As illustrated in FIGS. 5 and 6, the present example includes two couplers 64. Couplers 64 are used for receiving cotter pin 56 or another means for coupling to an external device.

First body portion 60 may also include a first planar member 68 that is coupled to second body portion 62. First planar member 68 is generally parallel to the deck surface 30A. The first planar member rests upon the second body portion. Coupler 64 may extend in a direction perpendicular to first planar member 68 and thus deck 30. A flange 70 may be coupled between first planar member 68 and coupler 64. Flange 70 is an optional feature of first body portion 60. The flange 70 may include a cutout 71 to allow access for a coupling device.

The second portion 62 may also be formed of a unitary structure integral with first body portion 60 or separately therefrom. Second body portion 62 may include a second planar member 72. Second planar member 72 is preferably sized larger than the opening 52 described above. Second planar member 72 may, for example, be wider, longer or both wider and longer than the opening 52. At minimum, the second planar member 72 is preferably longer or wider than the opening 52. The second planar member 72 rests against the upper surface of the deck surface 30A.

Second body portion 62 includes a lower member 74 that has notch 50 therein. Notch 50 has a height similar to (or just greater than) that of the surface of the deck so that the surface 30A of the deck 30 may be received therein. Notch 50 is generally U-shaped and is positioned along a lateral edge or side of the deck leverage anchor. Of course, those skilled in the art will recognize that the notch 50 may be formed in a longitudinal edge of the second body portion. The lower member 74 has a width W sized to be received within the opening. The lower member 74 may also have a length L1 that is smaller than the length of the opening. The length L1 corresponds to the distance from the edge of the notch to the end of the lower member 74. Lower member 74 has a length L2 that extends from the outer portion of notch 50 to the end of the lower member 74. Thus, the notch is formed by the difference between L1 and L2. The leftmost extent of L2 may extend the same distance as second planar member 72.

The first body portion 60 and the second body portion 62 may be coupled together using a fastener 76. Fastener 76 is coupled within a channel 78 that extends through first planar member 68 and second body portion 62. A bolt is illustrated as the fastener 76. A nut 80 may be used to hold the fastener 76 in place. Nut 80 may be fixedly coupled such as welded to the lower member 74. Of course, nut 80 may be located in the position of the fastener head 82. Nut 80 may also be welded to bolt after assembly to prevent later disassembly.

A second channel 84 may be formed through the second body portion 62. That is, the second channel 84 may be formed through the second planar member 72 and the lower member 74. The channel 84 may be used to receive a fastener, for example, that couples to or is part of the fastener plate 42.

Figure 7:
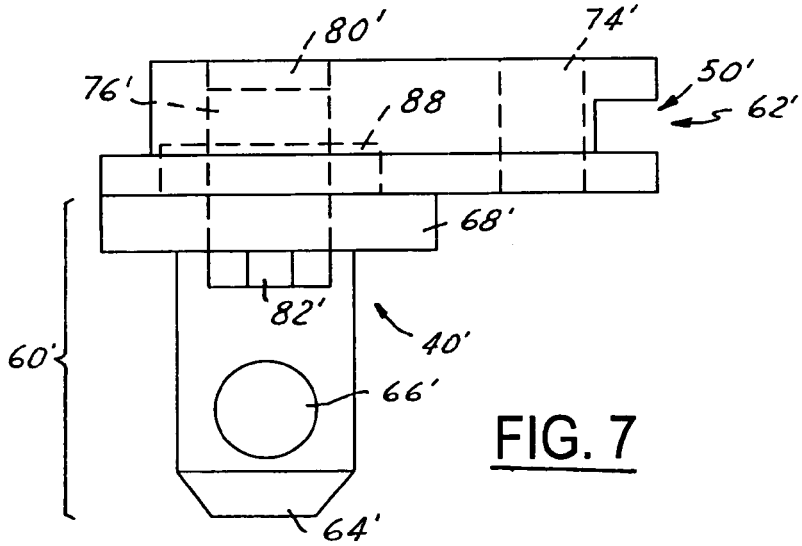
FIG. 7 is a side view of a second embodiment of the present invention.
Figure 8:
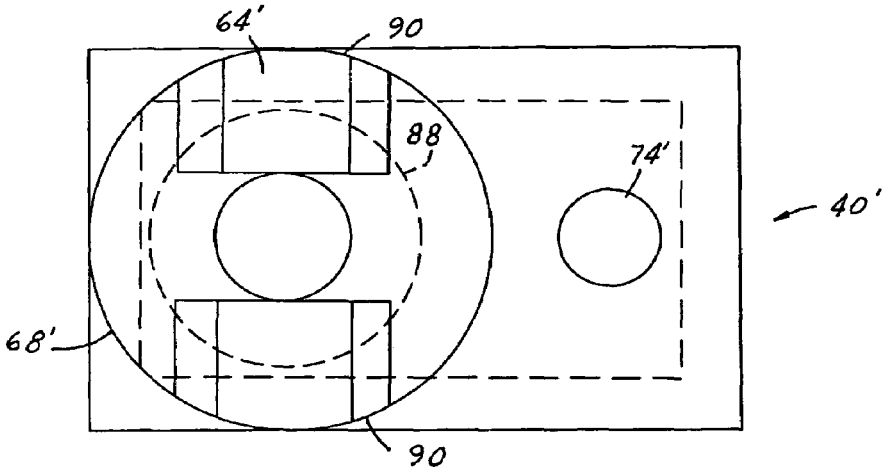
FIG. 8 is a top view of the deck leverage anchor of FIG. 7.
Figure 9:
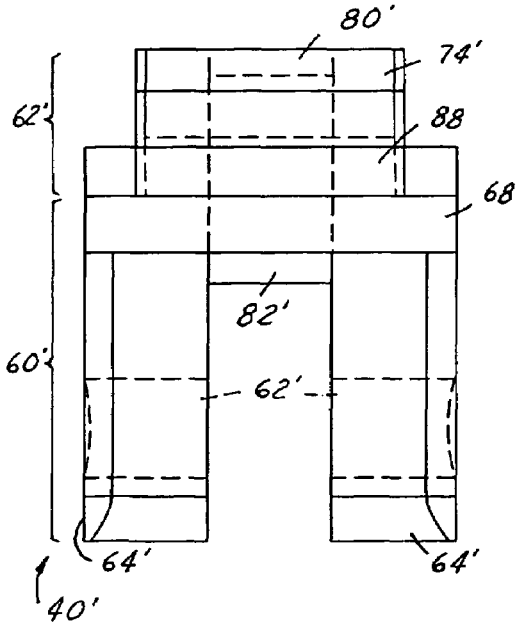
FIG. 9 is a left side view of the deck leverage anchor of FIG. 7.

Referring now to FIGS. 7, 8 and 9, a deck leverage anchor 40' is illustrated. The embodiments shown in FIGS. 7, 8 and 9 will use the same reference numerals for the same components but are primed. The one difference between this embodiment and the embodiments illustrated in FIGS. 4, 5 and 6 is that no flange 70 is provided on the first body portion 60'. Also, an extension portion 88 that extends from the first planar member 68' and extends into the second body portion 62 is provided. The extension 88 is circular in shape and allows the first portion 60 to rotate relative to the second portion 62. The fastener 76' allows the first body portion 60 to rotate relative to the second body portion 62. In one constructed embodiment, the extension portion 88 extends over ⅜", into the second body portion 62'.

It should also be noted that the extension portion 88 is comprised of a circular or disc-shaped portion that extends perpendicularly into the first body portion 60 relative to the deck surface 30A. Preferably, the extension 88 is preferably integrally formed with the first body portion 60.

In this embodiment, the first planar member 68' is ½" thick. The second planar member is ⅜" thick while the overall thickness of the second body portion 62' is 1.25". The distance that the first body portion 60 extends from the second body portion is 3.0" in this constructed embodiment. Hole 66' is point 0.925".

As is best shown in FIG. 88, another distinguishing feature from that of the previous embodiment is that the edges 90 of the couplers 64' have a partially rounded top view to correspond with the overall rounded or circular shape of the first planar member 68'.

Another change from the previous embodiment is that the nut 80' may be recessed within (or integrally formed with) the lower member 74'.

Figure 10:
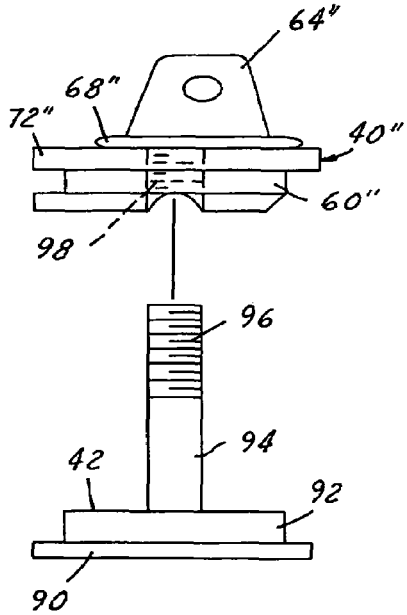
FIG. 10 is a view of a third embodiment of a deck leverage anchor relative to a fastener plate according to the present invention.

Referring now to FIG. 10, a third embodiment of deck leverage anchor 40" is illustrated. The main difference between this embodiment and the previous embodiments is that the coupler portion 64" is trapezoidal in shape. The trapezoidally-shaped coupler 64" is coupled to a first planar member 68" which in turn is positioned against second planar member 72". More than one coupler may be used as in the previous embodiments. As illustrated, a fastener plate 42 is illustrated. Fastener plate 42 has a third planar member 90 that is sized greater than the opening of the deck 30. The third planar member 90 may, for example, be longer or wider than the opening within the deck 30. The third planar member may also be both longer and wider than the opening in deck 30. A second portion 92 of fastener plate 42 is sized to fit within the opening of deck 30. An anchor bolt 94 is used to secure the fastener to the deck leverage anchor 40. As is illustrated, anchor bolt 94 may have threads 96 thereon which engage threads 98 extending through the first body portion 60" of the deck leverage anchor 40'. Fastener plate 42 may be used to hold the deck leverage anchor 40" in place upon the use of a large amount of force and/or the use of a high pulling angle (from the deck surface) or skewed angle relative to the opening that may cause the deck leverage anchor 42 to be released from the opening. The fastener plate 42 may be used with any of the embodiments above. In the constructed embodiment, fastener plate 42 was an optional feature.

Figure 11:
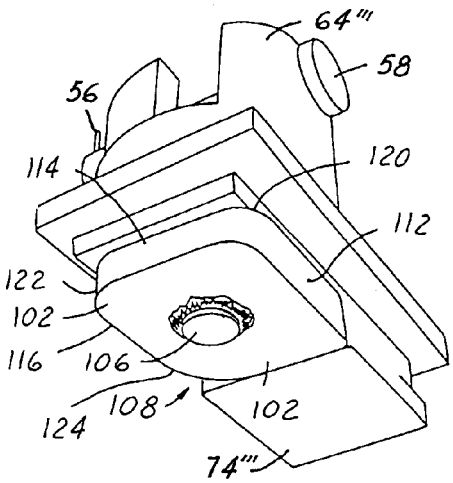
FIGS. 11-16 are views of an alternative embodiment of a deck leverage anchor shown in various positions.
Figure 12:
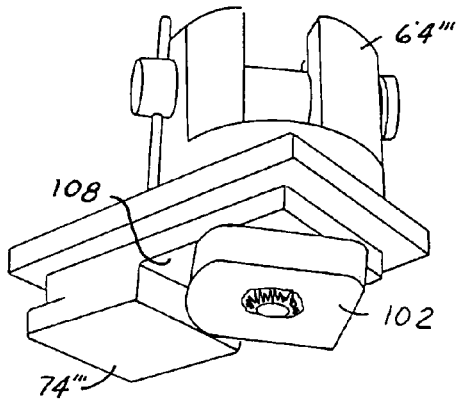
Figure 13:
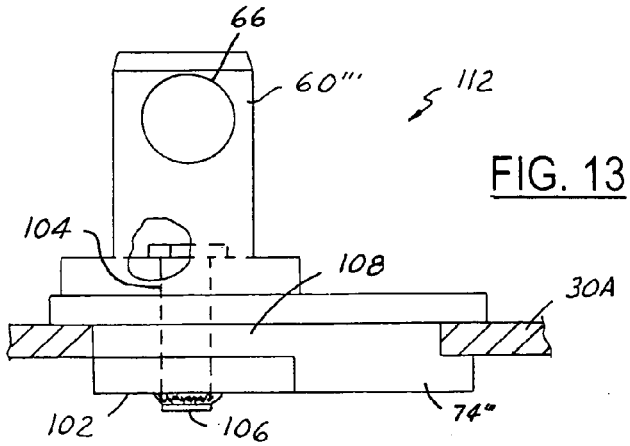

Referring now to FIGS. 11-16, another alternative embodiment of the deck leverage anchor is illustrated. In this embodiment a portion of the deck leverage anchor swivels, namely, the coupler, which may be referred to as a swivel coupler 64'''. The embodiment shown in FIGS. 11-16 are best illustrated when compared to FIGS. 7, 8 and 9 above. In this embodiment, the first body portion 60''' swivels together with a swivel plate 102 which may be thought of as part of or adjacent to the lower member 74'''. The swivel plate 102 rotates with the first body portion 60''', (swivel coupler 64''') into various positions to engage the deck surface after being inserted in a deck opening. The swivel plate 102 is opposite the swivel coupler 64''' relative to the anchor device end, when mounted to the surface. Thus, the swivel coupler 102 has a first position not engaged with the deck surface (for insertion into the deck opening) and a second surface engaging beneath the deck surface). As is best shown in FIG. 13 an axle 104 such as a bolt may be fixedly coupled to the coupler 64''' and to the swivel plate 102. A nut 106 may be welded to the swivel plate 102.

Lower member has a reduced thickness portion 108 as is best shown in FIG. 13. The shape and size of the reduced thickness is such that it receives the swivel plate 102.

Swivel plate 102 has a first side 110, a second side 112, a third side 114 and a fourth side 116. The first and third sides are preferable parallel to each other. Likewise, the second and fourth sides are preferably parallel. Adjacent sides are preferably perpendicular to each other. The first side 110 and second side 112 may have a perpendicular (90 degree) intersection 118. The second side 112 and third side 114 may have an intersection 120 with a first radius. The third side 114 and the fourth side 116 may have an intersection 122 with a second radius. The first radius may be substantially the same as the second radius. The fourth side 116 and the first side 110 may have an intersection 124 with a third radius 124. The third radius may be greater than the first and/or second radius.

Figure 14:
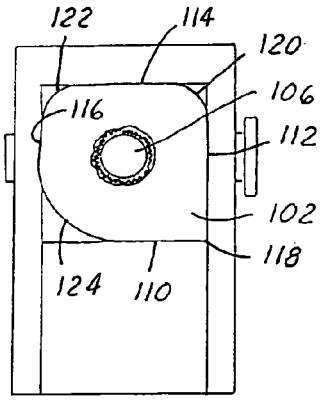
Figure 15:
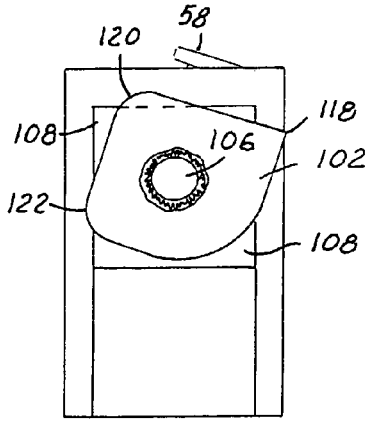
Figure 16:
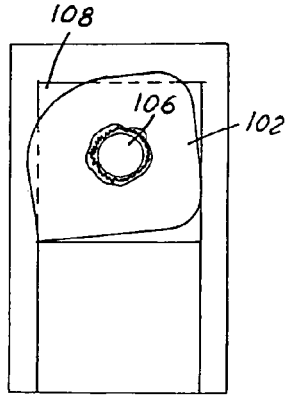

When used in a frame rack environment, it may be desirable to pull or push at various angles. By providing the swivel mechanism, the swivel plate 102 extends and clips or latches underneath the frame rack deck when the first body portion 60''' is in various positions. This distributes the load across the deck surface 30A and therefore reduces damage during pushing or pulling. In FIGS. 11 and 14 the swivel portion does not extend wider than the lower member 74'''. The position of FIGS. 11 and 14 is best used in a straight ahead or only slightly angular position. For example, less than 60 degrees from the longitudinal axis of the device. In FIGS. 12, 15 and 16, the swivel portion 102 along with the upper portion 60''' is positioned at an angle. FIG. 13 shows in dashed lines the swivel plate 102 engaging deck 30A. As can be seen, a portion of the swivel plate 102 extends outward laterally to engage the surface of frame rack to maintain the deck leverage anchor in a position on the frame rack. In FIG. 15 three areas of swivel plate 102 engage the deck; the portion near interesections 118, 120 and 122. The swivel portion is positioned beneath the surface. In FIG. 16 the leverage anchor has the swivel plate 102 fully rotated in a counter-clockwise manner. Various portions of the swivel plate extend beyond the width and length of the underlying lower member 74'''.

While particular embodiments of the invention have been shown and described, numerous variations and alternate embodiments will occur to those skilled in the art. Accordingly, it is intended that the invention be limited only in terms of the appended claims.

What is claimed is:

1. An anchor device for coupling an external device to a surface of a deck, said anchor device being received within an opening of the surface, said opening having an edge of the surface therein, said anchor device comprising:

an anchor body positioned at least partially within said opening so that a notch receives the edge of the surface, said anchor body comprising a swiveling coupler extending outward from the opening, said swiveling coupler coupling to the external device above the surface, said anchor body further comprising a swivel plate below the surface that swivels and is coupled to the swiveling coupler.

2. An anchor device as recited in claim 1, wherein the notch comprises a generally U-shape notch.

3. An anchor device as recited in claim 1, wherein the anchor has a longitudinal side and a lateral side, said notch formed in the lateral side.

4. An anchor device as recited in claim 1, wherein the swiveling coupler comprises a first coupler and a second coupler.

5. An anchor device as recited in claim 4, wherein said first coupler and said second coupler having a respective first coupling hole and a second coupling hole therethrough.

6. An anchor device as recited in claim 5, wherein said first coupling hole and said second coupling hole are coaxial.

7. An anchor device as recited in claim 1, wherein the anchor body comprises a first body portion and a second body portion, said first body portion having the swiveling coupler and said second body portion comprising said notch.

8. An anchor device as recited in claim 7, wherein the second body portion is rotatably coupled to the first body portion.

9. An anchor device as recited in claim 7, wherein the second body portion and the first body portion form a unitary structure.

10. An anchor device as recited in claim 7, wherein the first body portion has a first planar member extending parallel to said surface, said coupler extending in a direction perpendicular to said first planar member.

11. An anchor device as recited in claim 10 further comprising a flange coupled to said first planar member and said coupler.

12. An anchor device as recited in claim 7, wherein said second body portion comprises a second planar member coupled to said first body portion.

13. An anchor device as recited in claim 12, wherein said second planar member is sized greater than said opening.

14. An anchor device as recited in claim 12, wherein the second planar member has a first width greater than an opening width.

15. An anchor device as recited in claim 12, wherein the second planar member has a first length greater than an opening length.

16. An anchor device as recited in claim 12, wherein the second planar member has a first length greater than an opening length and a first width greater than an opening width.

17. An anchor device as recited in claim 16, wherein the second planar member is parallel to the surface.

18. An anchor device as recited in claim 7, wherein said second body portion comprises a reduced thickness portion sized to rotatably receive the swiveling coupler.

19. An anchor device as recited in claim 7, wherein the swiveling coupler comprises a first and third parallel sides and a second and a fourth parallel side, said first and third sides generally perpendicular to the second and fourth side.

20. An anchor device as recited in claim 19, wherein said swiveling coupler has a perpendicular first intersection between said first side and said second side.

21. An anchor device as recited in claim 20, wherein said swiveling coupler has a second intersection between said second side and said third side having a first radius therebetween.

22. An anchor device as recited in claim 21, wherein said swiveling coupler having a third intersection between said first side and said second side having a second radius therebetween.

23. An anchor device as recited in claim 22, wherein the first radius is substantially equal to the second radius.

24. An anchor device as recited in claim 22, wherein said swiveling coupler having a fourth intersection between said first side and said fourth side having a third radius.

25. An anchor device as recited in claim 24, wherein the third radius is greater than the second radius.

26. An anchor device as recited in claim 1 further comprising an axle disposed between the swiveling coupler and the swivel plate.

27. An anchor device as recited in claim 26, wherein the axle comprises a bolt.

28. An anchor device as recited in claim 27, wherein the bolt is fixedly coupled to the swiveling coupler and the swivel plate.

29. An anchor device as recited in claim 27, wherein the bolt is fixedly coupled to the swivel plate with a nut.

30. An anchor device as recited in claim 22, wherein said nut is welded to the swivel plate.

31. An anchor device as recited in claim 29 further comprising a flange coupled to said first planar member and said coupler.

32. An anchor device for coupling an external device to a surface of a deck, said anchor device being received within an opening of the surface, said opening having an edge of the surface therein, said anchor device comprising:

a first body portion positioned at least partially within said opening so that a notch receives the edge of the surface and partially positioned on said surface over said opening and a first member is positioned over the opening to engage a top surface of the deck; and a second body portion having a swiveling coupler extending outward from the first body portion, said swiveling coupler coupling to the external device, said second body portion rotatably coupled to a swivel plate so that upon rotation the swivel plate engages a bottom surface beneath the top surface.

33. An anchor device as recited in claim 32, wherein said second body portion comprises a reduced thickness portion sized to rotatably receive the swiveling coupler.

34. An anchor device as recited in claim 32, wherein the swiveling coupler comprises a first and third parallel sides and a second and a fourth parallel side, said first and third sides generally perpendicular to the second and fourth side.

35. An anchor device as recited in claim 34, wherein said swiveling coupler has a perpendicular first intersection between said first side and said second side.

36. An anchor device as recited in claim 35, wherein said swiveling coupler has a second intersection between said second side and said third side having a first radius therebetween.

37. An anchor device as recited in claim 36, wherein said swiveling coupler having a third intersection between said first side and said second side having a second radius therebetween.

38. An anchor device as recited in claim 37, wherein the first radius is substantially equal to the second radius.

39. An anchor device as recited in claim 37, wherein said swiveling coupler having a fourth intersection between said first side and said fourth side having a third radius.

40. An anchor device as recited in claim 39, wherein the third radius is greater than the second radius.

41. An anchor device as recited in claim 32 further comprising an axle disposed between the swiveling coupler and the swivel plate.

42. An anchor device as recited in claim 41, wherein the axle comprises a bolt.

43. An anchor device as recited in claim 42, wherein the bolt is fixedly coupled to the swiveling coupler and the swivel plate.

44. An anchor device as recited in claim 42, wherein the bolt is fixedly coupled to the swivel plate with a nut.

45. An anchor device as recited in claim 32, wherein the notch comprises a generally U-shape notch.

46. An anchor device as recited in claim 45, wherein the anchor has a longitudinal side and a lateral side, said notch formed in the lateral side.

47. An anchor device as recited in claim 32, wherein said second body portion comprises a second planar member coupled to said first body portion.

48. An anchor device as recited in claim 47, wherein said second planar member is sized greater than said opening.

* * * * *